US007069940B2

(12) United States Patent
Tsai

(10) Patent No.: US 7,069,940 B2
(45) Date of Patent: Jul. 4, 2006

(54) STRUCTURE OF A CRUTCH

(76) Inventor: Mu-Chang Tsai, No. 43, Guosheng 1st St., Chiayi City 600 (TW)

( * ) Notice: Subject to any disclaimer, the term of this patent is extended or adjusted under 35 U.S.C. 154(b) by 63 days.

(21) Appl. No.: 10/994,238

(22) Filed: Nov. 23, 2004

(65) Prior Publication Data

US 2006/0107982 A1 May 25, 2006

(51) Int. Cl.
*A61H 3/02* (2006.01)

(52) U.S. Cl. ..... 135/72; 135/73; 135/76; 403/396; 403/109.3

(58) Field of Classification Search ..... 135/65, 135/68, 71–73, 76; 403/385, 389, 396, 109.3, 403/109.6, 378
See application file for complete search history.

(56) References Cited

U.S. PATENT DOCUMENTS 2,669,244 A * 2/1954 Greene et al. ..... 135/72
4,979,533 A * 12/1990 Hansen et al. ..... 135/69
5,291,910 A * 3/1994 Bui et al. ..... 135/68
5,381,813 A * 1/1995 Miric et al. ..... 135/72
5,402,811 A * 4/1995 Weng ..... 135/68
6,079,431 A * 6/2000 Su ..... 135/72
6,314,977 B1 * 11/2001 Obitts et al. ..... 135/68

FOREIGN PATENT DOCUMENTS

JP 7-328083 * 12/1995
JP 2000-237253 * 9/2000

* cited by examiner

*Primary Examiner*—Winnie Yip
(74) *Attorney, Agent, or Firm*—Rosenberg, Klein & Lee

(57) ABSTRACT

A crutch has an adjustable crosspiece between two upright tube portions thereof, which includes a main body having tunnels lengthways extending along two end portions, two engaging pins respectively in the tunnels, springs for making the pins project out from the tunnels, two control members positioned next to and movable along the end portions of the main body, and two linearly displaceable bars on lateral sides of the main body, each of which connects a respective one of the pins to a respective one of the control members such that the pins are displaceable together with the control members; immediately after the control members are moved further away from each other, the pins will be retreated into the tunnels and disengaged from the uprights, and the crosspiece is adjustable; after the crosspiece is moved to a new position, the control members are released for the pins to engage the upright tubes.

4 Claims, 5 Drawing Sheets

STRUCTURE OF A CRUTCH

BACKGROUND OF THE INVENTION

1. Field of the Invention

The present invention relates to a crutch, more particularly one equipped with a crosspiece for a user to hold with one hand, which is structured in such a way as to not have to be connected with the upright support tubes of the crutch by means of threaded elements, and which can be easily and rapidly relocated to new portions of the upright support tubes.

2. Brief Description of the Prior Art

Referring to FIG. 1, a conventional crutch 1 includes two hollow uprights 11, an arm piece 12 securely connected to upper ends of the uprights 11, a crutch tip 13 connected to lower ends of the uprights 11, and a crosspiece 16 for a user to hold with one hand. The hollow uprights 11 are bent such that upper portions thereof are apart and substantially parallel. Furthermore, the upper portions of the uprights 11 have transverse holes 14 spaced along them. The crosspiece 16 has screw holes 17 at two ends, and it is secured on the uprights 11 by means of threaded connecting elements 15, which are passed through the transverse holes 14, and screwed into the screw holes 17. Therefore, after the connecting elements 15 are separated from it, the crosspiece 16 can be relocated to different portions of the uprights 11 according to the user's need.

However, the crutch is found to have disadvantages as followings:

1. The threaded connecting elements are prone to get loose after the crutch has been used for a long period of time. Consequently, the connecting elements will fall off, and accidents might happen while one is using the crutch.

2. To adjust the height of the crosspiece, one has to first remove the threaded connecting elements, and finally connect the threaded elements back to the uprights and the crosspiece after the crosspiece is relocated to a new height. And, after having made the screw holes of the crosspiece exactly face selected ones of the holes of the uprights, he has to hold the crosspiece still while screwing back the threaded elements. Therefore, it takes a lot of time and labor to adjust the crosspiece.

SUMMARY OF THE INVENTION

It is a main object of the present invention to provide an improvement on a crutch to overcome the above disadvantages.

The crutch of the present invention has an adjustable crosspiece between two upright supporting tube portions thereof, which crosspiece includes a main body having tunnels lengthways extending along two end portions, two engaging pins respectively in the tunnels, springs for making the pins project out from the tunnels, two control members positioned next to and movable along the end portions of the main body, and two linearly displaceable bars on lateral sides of the main body, each of which connects a respective one of the pins to a respective one of the control members such that the pins are displaceable together with the control members. Therefore, immediately after the control members are moved further away from each other, the pins will be retreated into the tunnels and disengaged from the uprights, and the crosspiece is adjustable. And, after the crosspiece is moved to a new position, the control members are released such that the springs make the pins to project out from the tunnels, and engage the upright tubes again.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
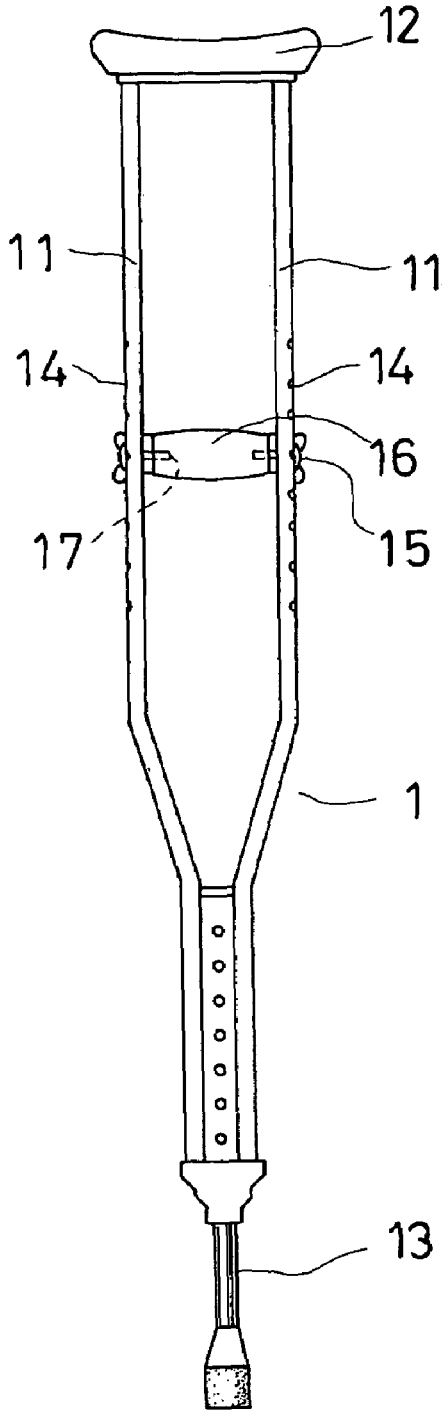
F I G. 1 (PRIOR ART)
FIG. 1 is a front view of the conventional crutch.
Figure 2:
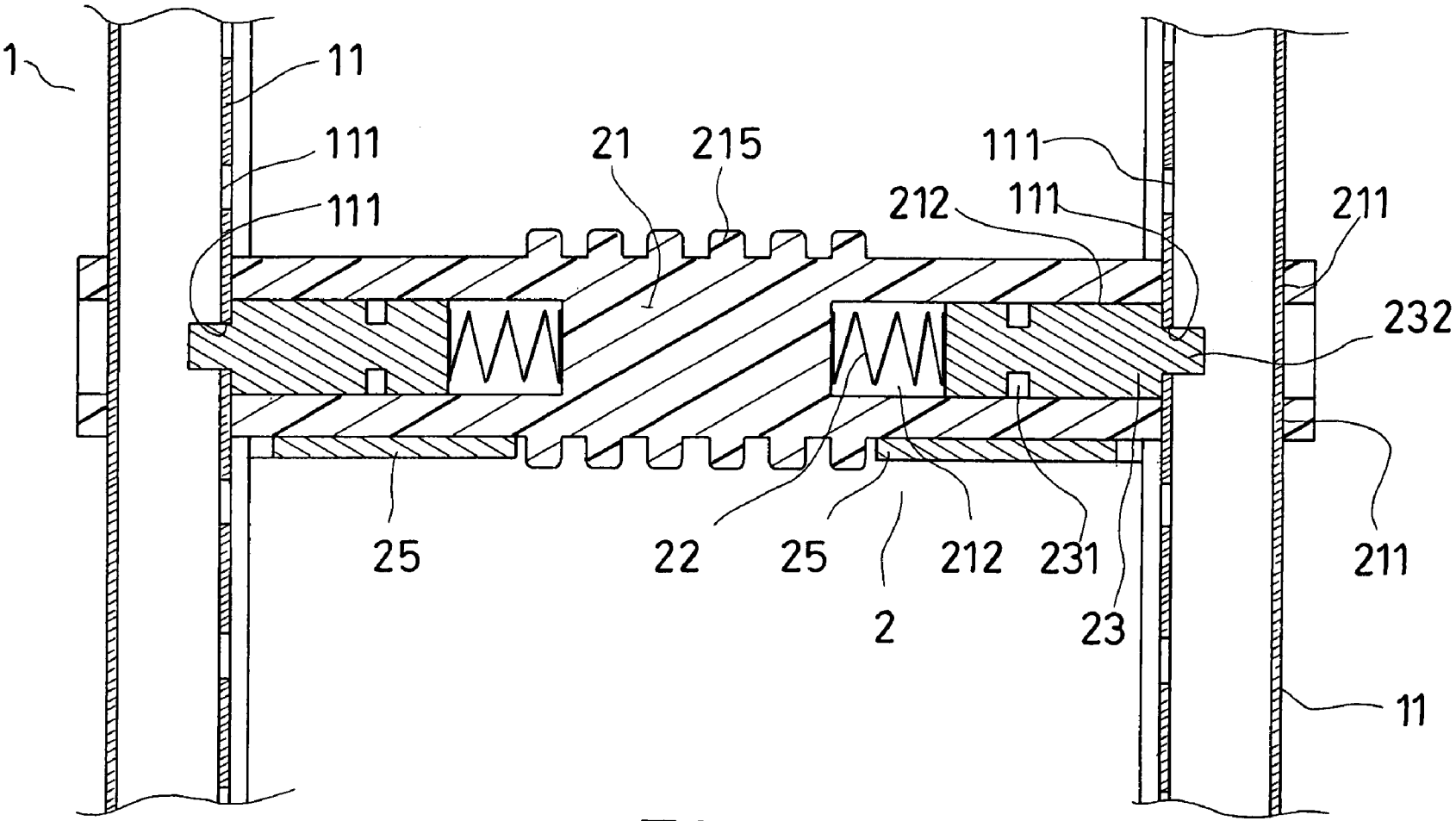
FIG. 2 is a vertical section of the crosspiece of a crutch according to the present invention.
Figure 3:
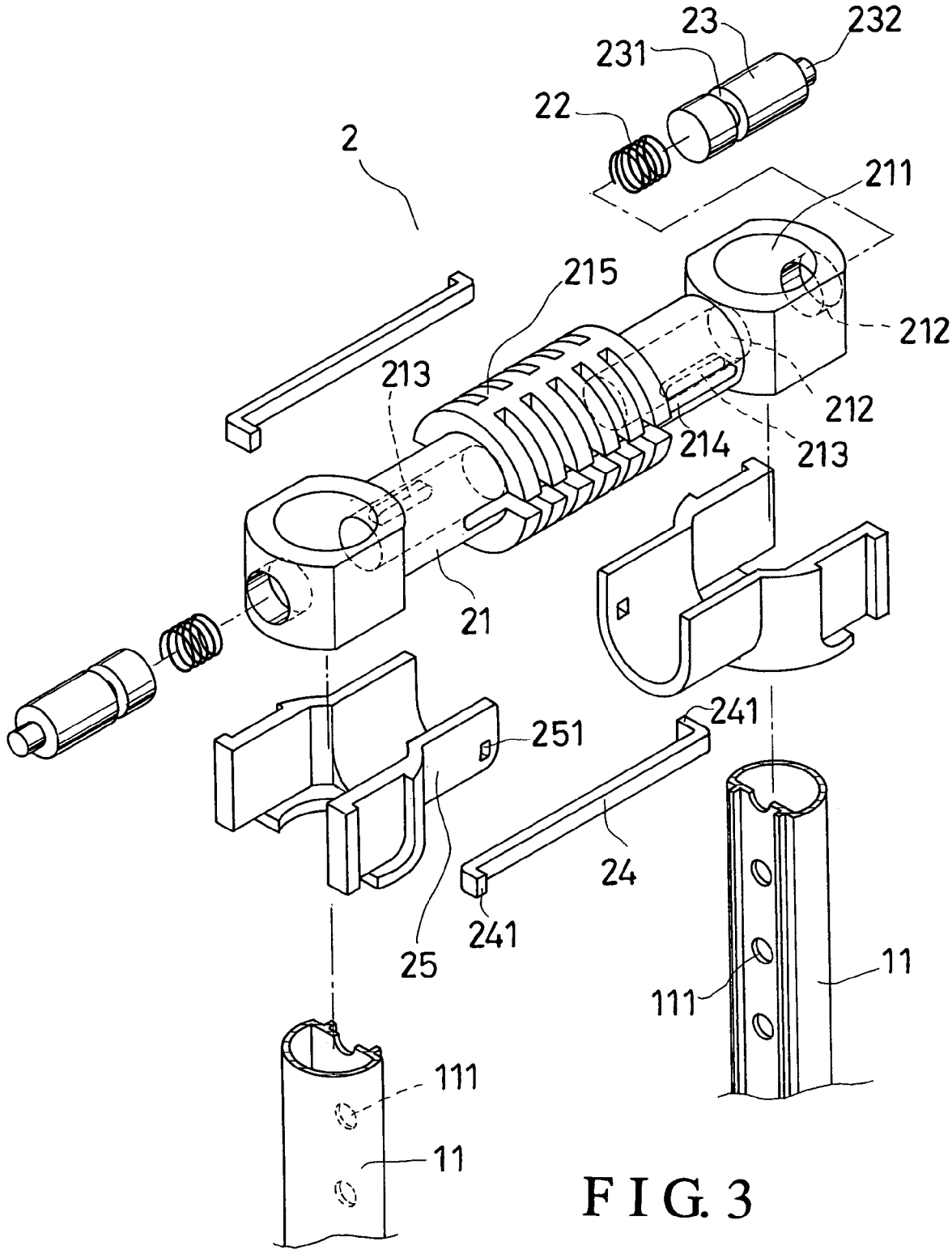
FIG. 3 is an exploded perspective view of the present crosspiece.
Figure 4:
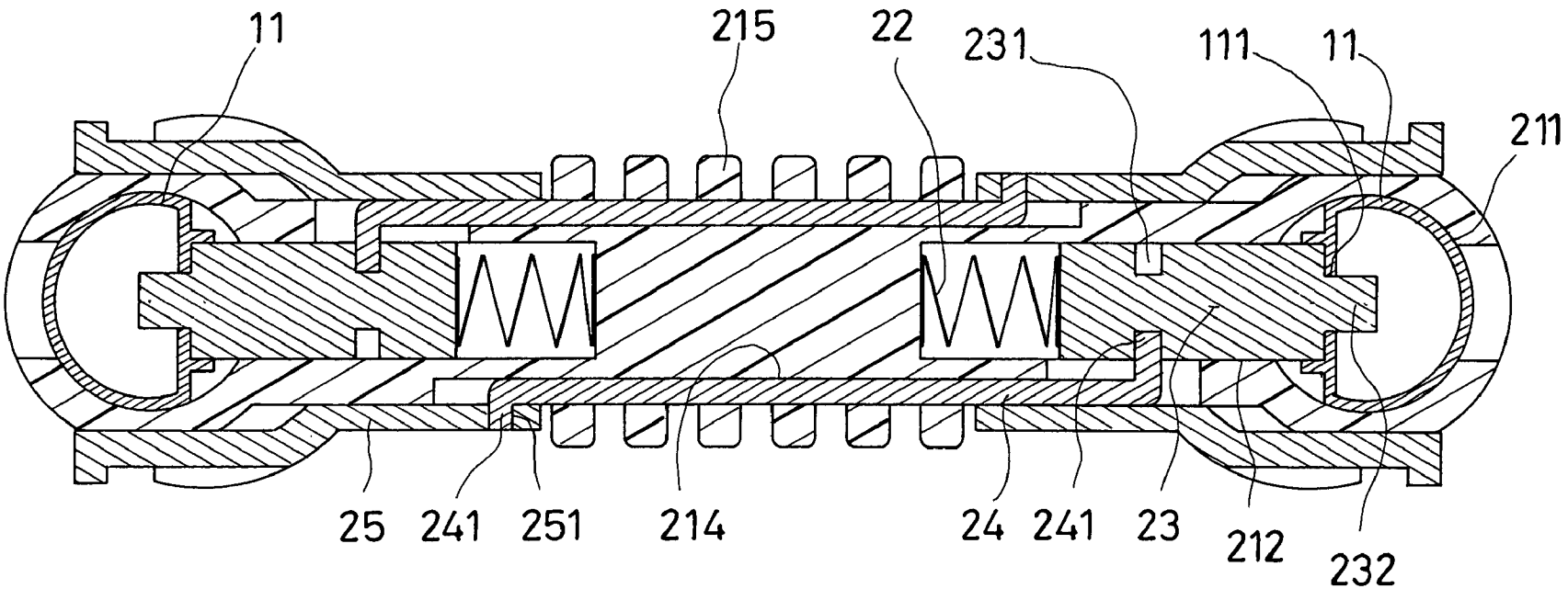
FIG. 4 is a horizontal section of the present crosspiece of a crutch, secured in position.
Figure 5:
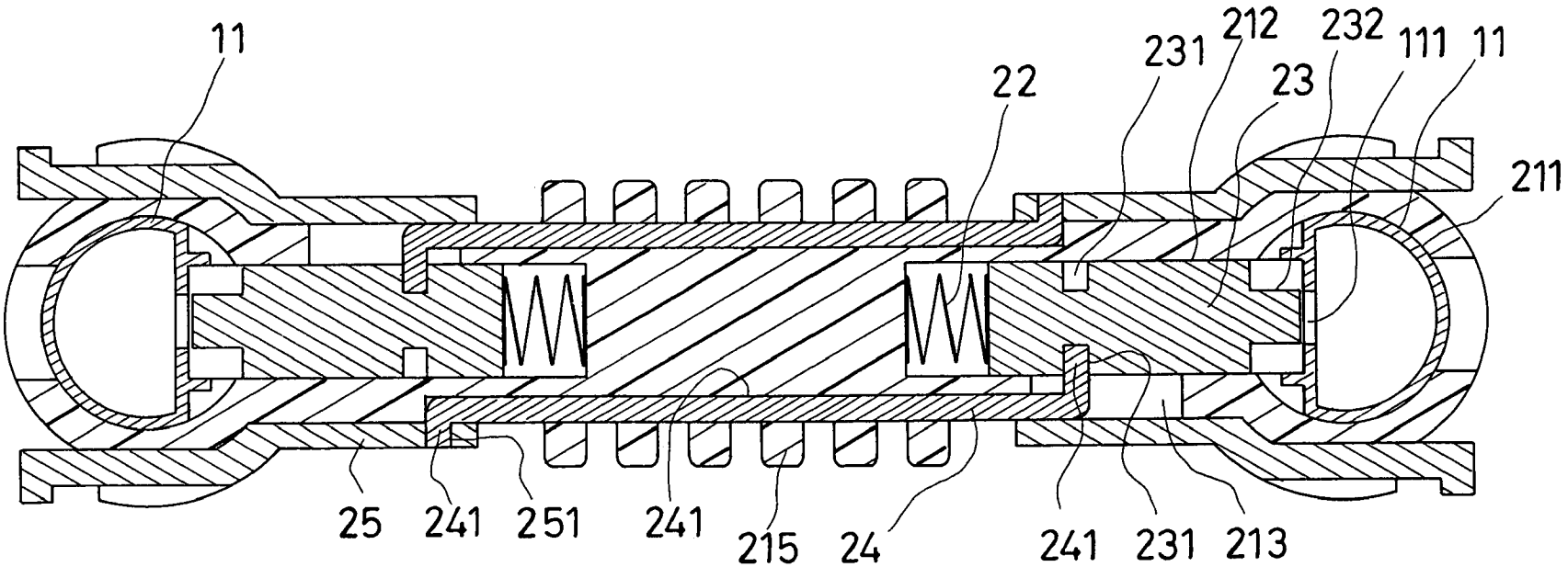
FIG. 5 is a horizontal section of the present crosspiece of a crutch, disengaged from the uprights to be adjustable in height.

Referring to FIGS. 2 and 3, a preferred embodiment of a crutch includes a pair of hollow uprights 11, and a crosspiece 2 for a user to hold with one hand.

The hollow uprights 11 are joined together at lower ends, and bent such that upper portions thereof are apart and substantially parallel. The upper portions of the hollow uprights 11 have holes 111 spaced along them, and the holes 11 of one of the uprights 11 are exactly faced with respective ones of the holes 11 of the other upright 11.

The crosspiece 2 includes a main body 21, two engaging pins 23, two connecting bars 24, and two control members 25.

The main body 21 has a middle slip-prevention portion 215, two end portions on two sides of the middle portion 215, two coupling holes 211 each extending from an upper side to a lower side of a respective one of two ends, two tunnels 212 respectively lengthways extending along the whole lengths of the end portions and communicating with the coupling holes 211, two grooves 214 on respective ones of two lateral sides, lengthways extending along the whole middle portion 215 and onto the two end portions, and two slots 213 respectively lengthways extending on the two end portions, facing in opposite directions and communicating with respective ones of the grooves 214 and the tunnels 212. The middle slip-prevention portion 215 is formed with cavities and protrusions thereon. Furthermore, the main body 21 is movably fitted around the hollow uprights 11 from the coupling holes 211 of the two end portions.

Each of the engaging pins 23 has an annular recess 231 between two ends thereof, and an engaging portion 232 at one end. The engaging pins 23 are respectively held in the tunnels 212 of the main body 21 in a linearly displaceable manner with the engaging portions 232 facing in the outward directions. In addition, elastic elements 22 are positioned in the tunnels 212, between the middle portion 215 and the engaging pins 23, for biasing the engaging pins 23 into the coupling holes 211 such that the pins 23 can pass into the holes 111 of the uprights 11 at the engaging portions 232 to secure the crosspiece 2 to the uprights 11.

Each of the connecting bars 24 has first and second hooked ends 241, which point in opposite directions. The connecting bars 24 are respectively held in the grooves 214 of the main body 21 with the first hooked ends 241 thereof respectively passing through the slots 213 and into the annular recesses 231 of the engaging pins 23; thus, the engaging pins 23 can be linearly displaced in the tunnels 212 when the connecting bars 24 slide on the grooves 214, and vice versa.

The control members 25 are respectively arranged on the two end portions of the main body 21 in a linearly displaceable manner. Each of the control members 25 has a hole 251 on a lateral side thereof, and the second hooked ends 241 of the connecting bars 24 pass into the holes 251 to engage the control members 25 respectively. Thus, the bars 24 connect the engaging pins 23 to respective ones of the control members 25, and in turns, the connecting bars 24 will slide along the grooves 214, and the elastic elements 22 will be compressed, and the engaging pins 23 retreated away from the coupling holes 211 to disengage the uprights 11 as soon as the control members 25 are moved further away from the middle portion 215 of the main body 21. Consequently, the crosspiece 2 can be linearly displaced along the uprights 11 for adjustment; after the crosspiece 2 has been moved to a desired position, the control members 25 are released, and in turns the elastic elements 22 make the engaging pins 23 pass into corresponding holes 111 of the uprights 11 to secure the crosspiece 2 to the uprights 11 again.

From the above description, it can be easily understood that the crutch of the present invention is relatively convenient to use because the crosspiece is easy to remove and fit in position, and it takes much less time and labor to adjust the crosspiece of the invention than it does to adjust conventional ones as described in Background.

What is claimed is:

1. A crutch, comprising (a) two hollow uprights joined together at lower ends, and bent such that upper portions thereof are apart and substantially parallel;

(b) a crosspiece for a person to hold with one hand, the crosspiece including:

(1) a main body up and down movably fitted around the uprights at two ends; the main body having a middle portion, and two end portions on two sides of the middle portion; the main body having two tunnels respectively lengthways extending along whole lengths of the two end portions thereof and capable of communicating with holes of the uprights; the main body having slots lengthways extending on the two end portions thereof and communicating with the tunnels;

(2) two engaging pins respectively held in the tunnels of the main body in a linearly displaceable manner;

(3) two elastic elements respectively positioned in the tunnels for making the engaging pins engage the uprights;

(4) two connecting bars linearly displaceable along respective ones of two lateral sides of the main body; each connecting bar having first and second hooked ends, which point in opposite directions; the first hooked ends being respectively passed through the slots and connected to the engaging pins such that the pins and the bars will move together;

(5) two control members respectively arranged on and linearly displaceable along the two end portions of the main body; each control member having a hole thereon; the connecting bars being respectively passed into the holes of the control members to engage the control members at the second hooked ends thereof for connecting the engaging pins to respective ones of the control members;

whereby the engaging pins will be retreated away and disengaged from the uprights as soon as the control members are pulled further away from each other, thus allowing the crosspiece to be linearly displaced along the uprights.

2. The crutch as claimed in claim 1, wherein the main body has two grooves lengthways extending along respective ones of two lateral sides thereof, and the connecting bars are positioned in respective ones of the grooves.

3. The crutch as claimed in claim 1, wherein the upper portions of the uprights have holes spaced along them, and the engaging pins have engaging portions at outward ends thereof for insertion into selected ones of the holes of the uprights.

4. The crutch as claimed in claim 1, wherein the middle portion of the main body of the crosspiece is formed with cavities and protrusions thereon for slip-prevention.

* * * * *